US005193723A

United States Patent [19]

Everett et al.

[11] Patent Number: 5,193,723

[45] Date of Patent: Mar. 16, 1993

[54] MORTAR APPLYING DEVICE

[75] Inventors: Alvin J. Everett, 1239 Wildwood Rd., Salem, Va. 24153; Steven Wells, Norfolk, Va.

[73] Assignee: A. J. Everett, Salem, Va.

[21] Appl. No.: 784,161

[22] Filed: Oct. 28, 1991

[51] Int. Cl.[5] ..... E04G 21/04

[52] U.S. Cl. ..... 222/611.2; 222/615

[58] Field of Search ..... 222/608, 611.1, 611.2, 222/612, 614, 615, 616

[56] References Cited

U.S. PATENT DOCUMENTS

| | | | |
|---|---|---|---|
| 1,374,881 | 4/1921 | Copeland | 222/616 |
| 1,578,077 | 3/1926 | Courney | 222/561 X |
| 2,341,691 | 3/1943 | Ciceske . | |
| 2,591,377 | 2/1950 | Sadler . | |
| 2,683,981 | 8/1950 | Richey . | |
| 3,148,432 | 5/1962 | Garnett | 222/611.2 X |
| 3,162,886 | 12/1964 | Wise . | |
| 3,268,121 | 3/1964 | Walker et al. | 222/616 X |
| 3,545,159 | 7/1968 | Brewer . | |
| 3,791,559 | 2/1974 | Foye | 222/611.2 |
| 3,826,410 | 7/1974 | Meyer | 222/611.2 X |
| 3,887,114 | 6/1975 | Villanovich . | |
| 4,043,487 | 7/1977 | Price | 222/611.2 X |
| 4,135,651 | 1/1979 | Hession et al. . | |
| 4,352,445 | 10/1982 | Cusumano et al. . | |
| 5,035,352 | 7/1991 | Mania | 222/611.2 |

*Primary Examiner*—Andres Kashnikow
*Assistant Examiner*—Kenneth Bomberg
*Attorney, Agent, or Firm*—Whitham & Marhoefer

[57] ABSTRACT

A mortar applying device (10) includes a motor (12) and hopper (14) mounted on a wheeled (18 and 50) frame (32). The wheels (18) can be driven at variable speeds using the throttle of the engine (12) to accommodate faster and slower rates of block laying. At the forward end of the frame (32) is an arm (34) and wheel (36) assembly which senses the end of the wall under construction and which activates motor cut off switch (44). The hopper (14) is lined with a low coefficient of friction, low adhesion material (70) to prevent mortar from clinging inside the hopper (14). The discharge element (66) located under the open bottom (64) of the hopper (14) includes an angled guide (72) which directs mortar out two exit ports (74 and 76). The height of the ribbons of mortar exiting under gates (80 and 82) is controllable and is smoothed over by a bevelled edge (88).

16 Claims, 3 Drawing Sheets

MORTAR APPLYING DEVICE

BACKGROUND OF THE INVENTION

1. Field of the Invention

The present invention generally relates to a motor driven mortar applying device for laying two beads of mortar along the top surface of a wall under construction.

2. Description of the Prior Art

Brick and block walls are assembled by skilled masons by applying mortar to the top and side surfaces of the bricks or blocks and stacking them in a stable configuration. Automating some of the operations performed by the mason would result in considerable savings in labor charges. For many years, efforts have been made to partially automate the procedure of applying mortar to the top surfaces of a wall of bricks or blocks. For example, U.S. Pat. No. 2,341,691 to Ciceske, U.S. Pat. No. 2,591,377 to Sadler, U.S. Pat. No. 3,545,159 to Brewer, U.S. Pat. 3,826,410 to Meyer, U.S. Pat. No. 4,135,651 to Hession et al., and U.S. Pat. No. 4,352,445 to Cusumano et al. each show mortar applying devices that are pushed or pulled across the top surface of a wall. In addition, U.S. Pat. No. 2,683,981 to Richey, U.S. Pat. No. 3,791,559 to Foye, and U.S. Pat. No. 3,887,114 to Villanovich each show wheeled mortar applying devices that are propelled across the top of a wall under construction by an operator turning a hand crank that drives the wheels. Most of the above-identified patents show the deposition of two beads of mortar along the top outer edges of the blocks in the wall.

A severe limitation of all the mortar applying devices shown in the above-identified patents is the requirement that an operator be present to move the mortar applying device across the top surface of the wall under construction. A hand propelled or maneuvered mortar applying device necessarily ties up one of the masons at a job site, thereby lowering the total productivity of the group. In addition, because an operator must stand and move alongside the wall under construction, he is in constant danger of bumping and moving the mason's line which is used for aligning the blocks that are being laid. Hence, a power driven mortar applying device represents a marketable improvement in terms of both the productivity of each of the masons at the job site and in maintaining the integrity of the mason's line. U.S. Pat. No. 4,043,487 to Price shows an example of a mortar applying device which is power driven. However, the Price design does not allow easy unsupervised application of mortar on top of the wall since it does not have an automatic cut off feature for sensing when the wall ends.

Many mortar applying devices use internal elements which contact the mortar while it is being deposited. For example, U.S. Pat. No. 3,162,886 to Wise discloses a mortar applying device which includes an auger for driving the mortar toward the exit ports, U.S. Pat. No. 2,683,981 to Richey discloses the use of impellers to stir the mortar, U.S. Pat. No. 3,791,559 shows the use of mortar working blades, and U.S. Pat. No. 4,352,445 to Cusumano et al. shows the use of paddles to even out the mortar in the beads which have been laid. Elements which contact the mortar present serious clean up problems for masons. If mortar is allowed to harden on the moving element, as would happen if the mortar applying device was not thoroughly washed at the end of a day, the mason is forced to chisel the element free before the device can be used again.

U.S. Pat. No. 4,135,651 to Hession et al. and U.S. Pat. No. 3,545,159 to Brewer show the use of gravitational forces in dispensing the mortar on the blocks in a wall, and U.S. Pat. No. 3,826,410 to Meyer and U.S. Pat. No. 4,043,487 to Price show the use of gravitational forces assisted by vibration. If gravity is to be used as the mortar feed mechanism, care must be taken to assure that the mortar is dispensed at approximately the same rate irrespective of the amount of mortar present in the hopper. Some prior mortar applying devices which use gravity suffer from the fact that mortar will be dispensed faster at the beginning of a run when the hopper is full, because of the downward force exerted by the weight of the mortar in the hopper, than at the end of the run when the hopper is nearly empty. Such a situation will lead to an uneven thickness of mortar in the wall which is unacceptable for proper construction.

SUMMARY OF THE INVENTION

It is therefore an object of this invention to provide an improved mortar applying device which overcomes the problems of the prior art.

It is another object of this invention to provide a motor driven mortar applying device which includes an automatic shut off feature capable of sensing the termination of a wall under construction.

It is another object of this invention to provide a gravity feed mortar applying device designed to ensure that mortar is deposited at substantially the same rate irrespective of the quantity of mortar in the hopper.

It is yet another object of this invention to provide a mortar applying device which is readily adaptable for use on walls with different sized blocks.

According to the invention, a mortar applying device which rides on top of a wall under construction and which deposits two beads of mortar on the top surface of the blocks at their outer edges includes a motor which propels the device across the top of the wall without hand contact by a mason. A means is preferably provided which allows the mortar applying device to proceed across the top of the wall at varying rates of travel since the optimum rate travel of the mortar applying device will typically be a function of the number of masons at a job-site. In addition, a clutch is provided which allows the motor to be disengaged from the drive wheels without being turned off so that a mason can stop the mortar applying device and restart it without having to start the motor.

Attached to a frame which supports the motor and the hopper is an automatic motor cut-off mechanism which can sense the end of the wall under construction and cause the mortar applying device to stop automatically. Hence, the mortar applying device can run the length of a wall unattended and stop automatically. In particular, the automatic motor cut-off mechanism includes an arm which rides along the wall in front of the frame. When the wall under construction ends against another wall that is higher, the arm is pushed against the higher wall and a cut-off switch is activated. Likewise, when the wall under construction ends by dropping off (no adjacent wall), the arm is allowed to fall downward in front of the frame to activate the cut-off switch.

The hopper has enhanced mortar dispensing features that ensure that mortar is dispensed at substantially the same rate during its operation irrespective of the quantity of mortar present in the hopper. Some of the mortar dispensing features include lining the hopper with a low coefficient of friction and low adhesion material, providing a dispensing guide at the bottom of the hopper which does not impede the progress of the mortar, and using the vibrations of the motor to shake the mortar towards the bottom of the hopper.

The frame is equipped with a plurality of wheels which distributes the weight of the apparatus across the top surface of the wall. Some of the wheels on the frame are pivotable while others are spring loaded so that wheels always contact the blocks, even if there are incongruities in the top surface of the wall. Wheeled guides hang from the frame and ride on the outside surfaces of the wall to maintain the correct positioning of the mortar applying device. The dispensing guide at the bottom of the hopper and the wheeled guides are adjustable to accommodate different sized blocks. In addition, the wheels on the frame are preferably wide enough to ride on blocks of differing widths.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
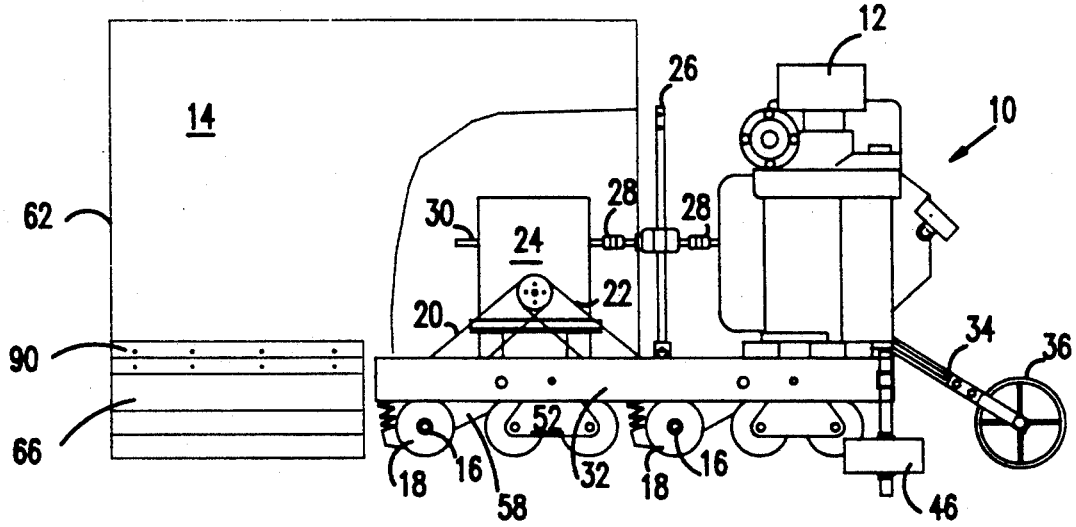
FIG. 1 is a side view of the mortar applying device according to the present invention.
Figure 2:
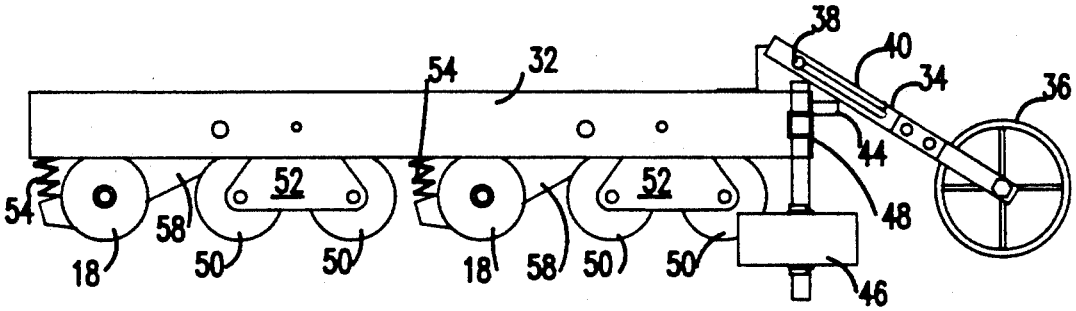
FIG. 2 is a side view of the frame for the mortar applying device showing in more detail the wheels, guides, and automatic motor cut-off mechanism.

Referring now to the drawings, and more particularly to FIGS. 1 and 2, there is shown a mortar applying device 10 having a motor 12 and a hopper 14. The motor 12 powers the drive axles 16 of drive wheels 18 via chains 20 and 22 in gearbox 24. The motor 12 can be a conventional two to four horsepower lawn mower type engine, or any other suitable power plant including both gas and electric motors. However, gas motors are preferable to electric motors since many construction job-sites are at remote locations which have limited or no electric power resources. A clutch 26 is positioned between the motor 12 and the gearbox 24 to allow starting and stopping power to the drive wheels 18 without shutting off the motor 12. Hence, the clutch 26 allows a mason to halt the progress of the mortar applying device 10 at any point along the top surface of a wall without having to restart the motor 12, thereby giving the mason more control of the mortar applying operation. Standard couplings 28 can be used to mechanically connect the clutch 26 in the drive train 30.

Figure 10:
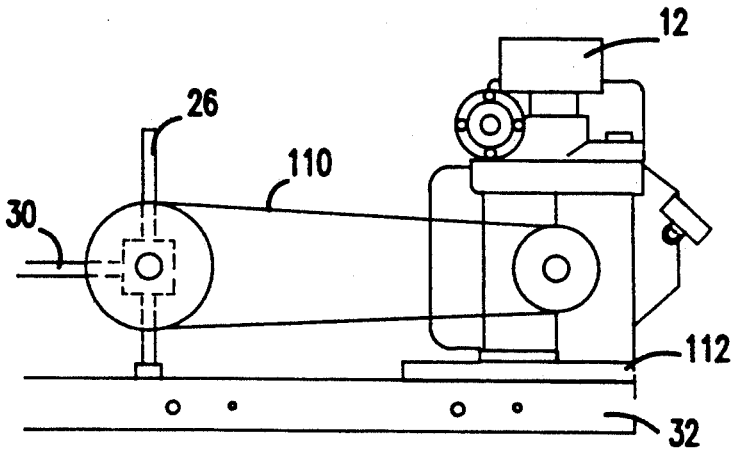
FIG. 10 is a side view of a variable speed pulley mechanism which can be used to transmit power to the drive wheels of the mortar applying device at varying rates.

Many times, a different number of masons will be working at one particular job site on different days. If there are a large number of masons present, it would be ideal to have the mortar applying device 10 travel over the top of the wall at a faster rate (i.e., twelve feet per minute) since the blocks at the top of the wall will be laid at a faster rate. Conversely, if a small number of masons are at the job site, the blocks will be laid at the top of the wall more slowly; therefore, it would be advantageous to slow the rate of travel of the mortar applying device down (i.e., four feet per minute) to adjust to the slower rate of block laying. A particular advantage of using the lawn mower type motor for motor 12 of the mortar applying device 10 is that the engine throttle can be used to regulate the rate of travel of the mortar applying device 10. By throttling the engine up, the power delivered to the drive axles 16 will be increased (preferably to a level which allows the mortar applying device to travel as much as twelve feet per minute), and by throttling the engine down, the power delivered to the drive axles 16 will be decreased (preferably to a level which allows the mortar applying device 10 to travel as slow as four feet per minute). FIG. 10 shows an alternative means for regulating power to the drive wheels which includes a variable speed pulley mechanism 110 connected to the drive wheels through the clutch 26. Variable speed pulley mechanisms are well known in the art and in this application the operation is such that by moving the motor 12 on tracks 112 relative to the clutch 26, the size of the variable speed pulley 110 will be altered; thereby, allowing the motor 12 to drive the drive wheels at variable speeds. Any other mechanism for regulating the speed of travel of the mortar applying device 10 is considered within the ambit of this invention.

Figure 11A:
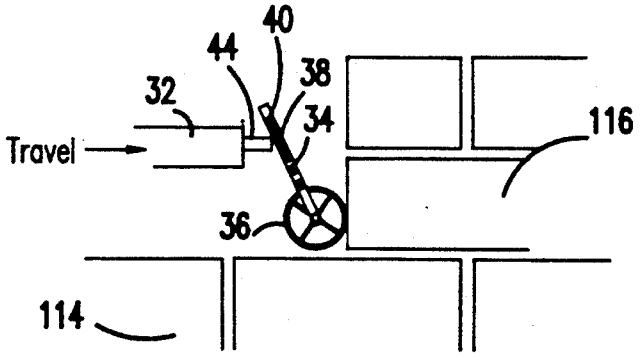
FIGS. 11*a* and 11*b* are representational side views of the front of the mortar applying device shown in FIGS. 1 and 2 illustrating the actuation of the mortar cut-off switch.
Figure 11B:
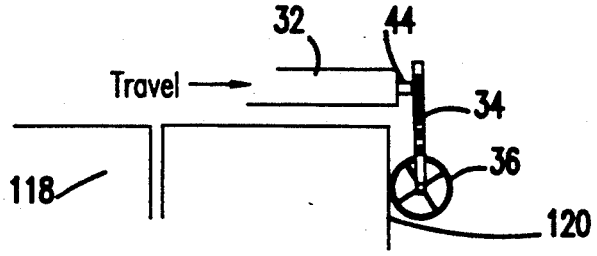

The frame 32 has an arm 34 with a wheel 36 extending from its forward end. The arm 34 and wheel 36 actuate motor cut-off switch 44 at the forward end of the frame 32 when the end of a wall is encountered. In operation, the wheel 36 will ride on the top surface of the wall of blocks which have been laid. As is best shown in FIG. 11*a*, when the wall 114 under construction terminates against a completed wall 116 which is taller, the wheel 36 will abut against wall 116 causing the arm 34 to pivot on pin 38 as the arm slides rearward via slot 40 and will actuate motor cut-off switch 44. As is best shown in FIG. 11*b*, when the wall 118 under construction simply terminates and a drop off point 120 is reached, the wheel 36 will drop off the edge of the wall 118 and the arm 34 will pivot downward to actuate the cut-off switch 44. Other mechanisms could be used for sensing the wall termination and are considered within the practice of this invention; however, the mechanism shown in FIGS. 1, 2, and 11*a–b*, is particularly advantageous since it is ruggedly constructed and can sense the termination of walls which end in two different ways. In one configuration, the motor cut-off switch 44 opens the spark plug current to ground to turn off the motor 12. However, the motor cut-off switch 44 could operate a device which causes the clutch 26 to simply disengage the drive wheels 18 at the end of a wall, rather than turning off the motor 12. All that is required is that the progress of the mortar applying device 10 be stopped at the end of a wall.

The automatic motor cut-off feature is an important part of the invention and allows the mortar applying device 10 to apply mortar unattended by a mason. Hence, after a row of blocks are laid, the mortar applying device 10 will be started at one end and allowed to progress to the other end of the wall. Since a mason does not need to maneuver the device 10, each mason at the job-site can begin to lay the next row of blocks once the mortar applying device 10 has passed his station. In addition, having the mortar applying device 10 run unattended has the advantage of maintaining the integrity of the mason's line which is used for aligning the blocks. The mason's line is strung adjacent the wall under construction to indicate the level at which blocks in the next row are to be laid. In the past, prior art mortar laying devices required a mason to maintain hands on control. Having hands on control necessarily puts the mason at risk of bumping or moving the mason's line.

Figure 7:
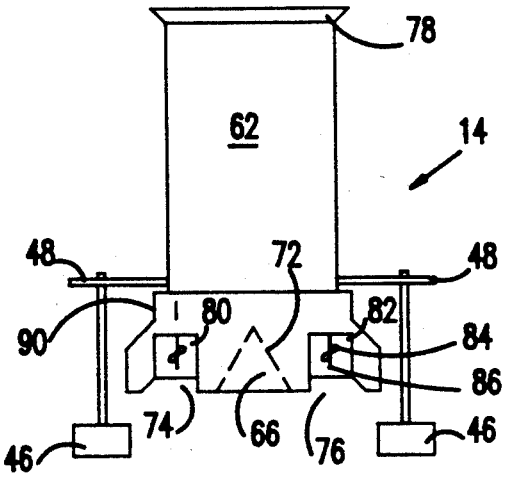
FIG. 7 is a rear view of the mortar applying device.

With reference to FIGS. 1, 2 and 7, the frame 32 also includes side wall guides 46 which hang downward from a cross-bar 48. The side wall guides 46 ride on the top outside edges of both sides of the wall and maintain the forward direction of the mortar applying device 10. Preferably, the side wall guides 46 are in the form of rollers which roll against the outside surface of the wall. It has been found that the side wall guides 46 do not need to hang down very far past the top edge of the wall to perform their direction stabilizing function and, preferably, the hanging position of the sidewall guides 46 is such that the mortar applying device 10 can be easily be lifted off the wall at its termination site from one side of the wall without having to worry about the sidewall guide 46 on the other side of the wall catching against the wall during lifting. In addition, the cross-bar 48 should have a plurality of hanging points (not shown) which allow the side wall guides 46 on either side of the frame 32 to be held at varying widths apart to accommodate walls being made with blocks of different widths (e.g., ten and twelve inch blocks in cross-section).

Referring to FIG. 2, the frame 32 includes several free wheels 50 and drive wheels 18 which serve to distribute the weight of the mortar applying device 10 over a larger area on the top of the wall. Preferably, the frame 32 spans over at least two blocks in the row (at least three feet), but is short enough to allow the mortar applying device 10 to be rotated by masons that are standing on scaffolding. The free wheels 50 can be connected to pivotable members 52 which allow them to adjust to the contours along the top surface of a wall. The top of the wall may not be even from block to block; therefore, the pivotable members 52 allow adjusting to higher and lower blocks so that the free wheels 50 are always in contact with the top surface of a block. The drive wheels 18 are equipped with a spring bias members 54 which force the wheels 18 downward against the top of the wall. Hence, if the forward drive wheel is on a block that is lower than the rear drive wheel, the spring bias member 54 biases it downward to contact the top of the wall so that it may aid in moving the mortar applying device forward.

Figure 3:
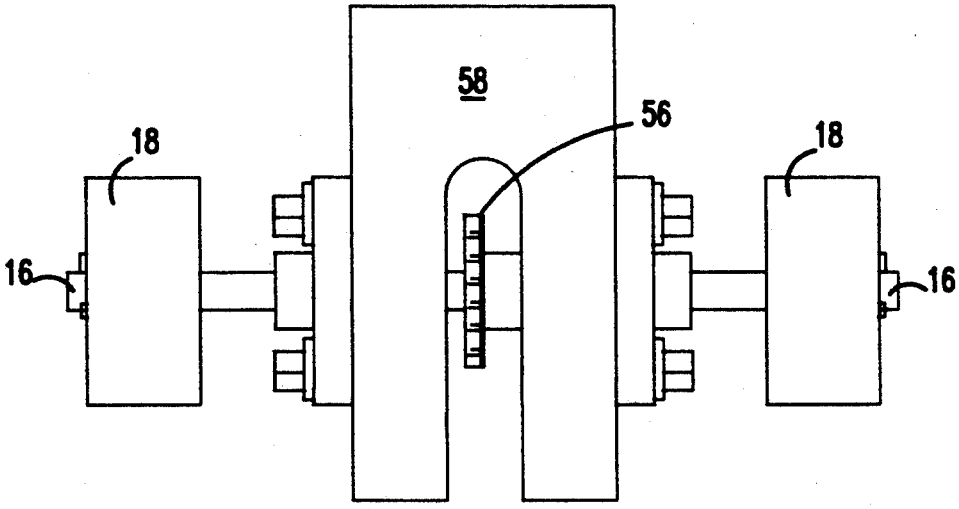
FIG. 3 is a top view of one of the drive wheel assemblies.

With reference to FIGS. 1 and 3, the forward and rear drive wheels 18 are driven by chains 22 and 20, respectively, each of which mesh with a sprocket 56 at the end of the arm 58. The sprocket 56 rotates the drive axle 16 which rotates the wheels 18. Having forward and rearward drive wheels spaced more than one block length apart (approximately a two foot spacing) is advantageous because slippage of one of the drive wheels 18 on the top surface of one block will not necessarily halt the forward progress of the mortar applying device 10 since the other drive wheel 18 is likely to have good traction.

Figure 4:
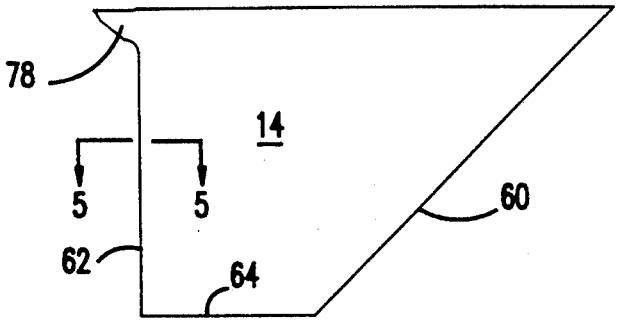
FIG. 4 is a cross-sectional side view of the hopper.

With reference to FIGS. 1 and 4, the interior of the hopper 14 has a downward slanted forward wall 60 and an upright rear wall 62. The downward sloping forward wall 60 directs the mortar towards the open bottom 64 of the hopper where it exits the discharge element 66 onto the top of the blocks in the wall. Having the forward wall 60 of the hopper 14 extend over the gear box 24 allows the mortar applying device 10 to have a shorter length dimension while still permitting the hopper 14 to hold a large amount of mortar. As is pointed out above, the shorter length dimension of the mortar applying device is important since it will need to be removed from the top of the wall and rotated by masons which are standing on scaffolding. Hence, the length dimension of the mortar applying device 10 should be short enough to allow its rotation on the size scaffolding required under Occupational Safety and Health Administration (OSHA) guidelines. In addition, the downward slant of the forward wall 60 allows some of the mortar to be initially stored towards the front of the mortar applying device 10, thereby allowing a more even distribution of weight.

Figure 5:
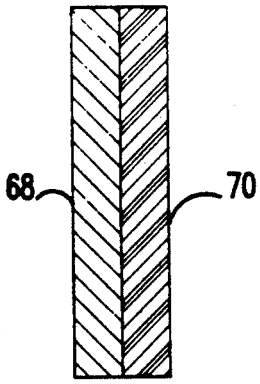
FIG. 5 is a cross-sectional side view of one of the walls of the hopper taken along line 5—5 of FIG. 4 showing that the walls are lined with a low coefficient of friction, low adhesion material.

For proper wall construction, it is important that the amount of mortar applied to the top surfaces of the blocks be fairly uniform. The mortar applying device of the present invention includes features which assure that the rate mortar is applied to the blocks is fairly uniform irrespective of the amount of mortar in the hopper 14. One feature for achieving uniform mortar deposition is best shown in FIG. 5 where it is shown that the walls of the hopper 14 are comprised of an external metal 68, such as aluminum or the coefficient of friction, low coefficient of adhesion plastic material 70 such as Teflon ® or Hyfax ®. Prior art mortar applying devices have not used a lined hopper; rather, they have simply been constructed of metal. The problem with using metal alone for the hopper is that it may have a high coefficient of friction as well as a high coefficient of adhesion which would impede the progress of the mortar towards the open bottom 64 of the hopper 14. This would become particularly important as the hopper 14 becomes empty at which time the mortar might have a tendency to cling to the inside walls of the hopper 14. The plastic liner 70 assures a slippery surface that prevents mortar from clinging inside the hopper 14. Another feature for assuring uniform mortar deposition is best shown in FIG. 1 where the motor 12 and hopper 14 are solidly affixed to a common frame 32. This design permits vibrations from the motor 12 to be transferred directly to the hopper 14 via the frame 32. The motor 12 vibrations aid in shaking the mortar towards the bottom 64 of the hopper 14.

Figure 6A:
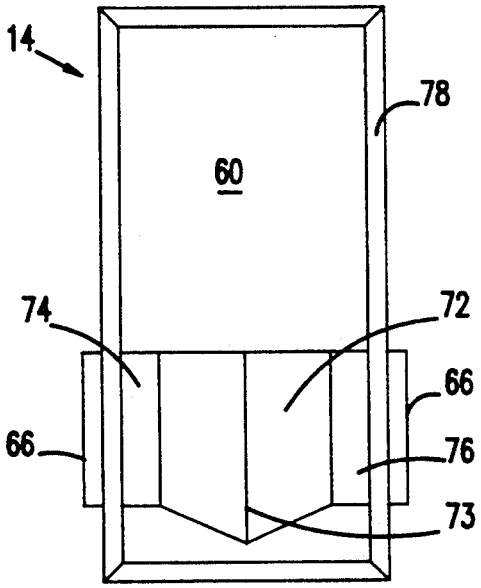
FIGS. 6*a* and 6*b* are top views of the hopper showing alternative mortar directing guides positioned at the bottom of the hopper.
Figure 6B:
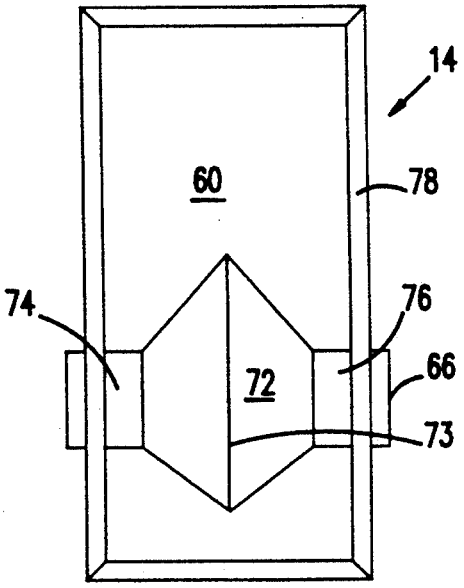

FIGS. 6*a* and 6*b* show alternative configurations of the mortar directing guide 72 located at the bottom 64 and toward the rear of the hopper 14. In FIG. 6*a*, the forward wall 60 of the hopper 14 terminates above the mortar directing guide 72, whereas in FIG. 6*b*, the mortar directing guide 72 partially extends up the forward wall 60 of the hopper 14. In either configuration, the mortar directing guide 72 is steeply angled with ridge 73 pointed upward and side walls directed down to side exit ports 74 and 76. The steep angle (preferably 60° or less between the side walls of the mortar directing guide 72) has been found to be important in maintaining a uniform rate of flow of mortar out the exit ports 74 and 76. Specifically, it has been found that if the mortar directing guide 72 has a relatively obtuse angle, mortar will tend to jam up at the exit ports 74 and 76 under the weight of the mortar in the hopper 14. However, if the mortar directing guide has an acute angle of 60°, mortar will flow freely out the exit ports 74 and 76, regardless of the amount of mortar in the hopper 14. In addition, as discussed above in regard to the hopper 14, the side walls of the mortar directing guide 72 are lined with a low coefficient of friction, low coefficient of adhesion material such as Teflon® or Hyfax®. The top of the hopper 14 is flared outwardly 78 to aid in pouring the mortar within the hopper 14.

Figure 8:
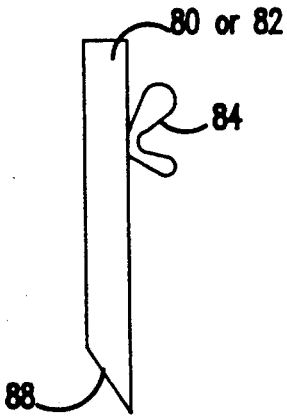
FIG. 8 is a cross-sectional side view of a door positioned over the exit ports of the mortar discharge element.

FIG. 7 shows the discharge element 66 located at the rear 62 of the hopper 14. The discharge element 66 has two spaced apart doors 80 and 82 respectively located at the outlet ports 74 and 76. Mortar is discharged out the doors 80 and 82 in the form of two ribbons of mortar located on the top outer edges of the blocks in the wall under construction. Wing nuts 84 operate in conjunction with a threaded member positioned within a slot 86 of each of the doors 80 and 82 so that they may be held at a variable height selected by the masons. Therefore, depending on the requirements for the building the height of the ribbons of mortar which are deposited on the blocks can be varied by adjusting the height of the doors 80 and 82. FIG. 8 shows that the bottom of the doors 80 or 82 are bevelled 88 towards the rear so that ribbons of mortar will have a smoother top surface.

Figure 9:
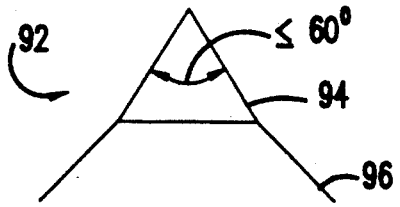
FIG. 9 is a cross-sectional side view of an A-frame mortar guide.

The mortar directing guide 72 positioned within the discharge element 66 is shown as a dashed line in FIG. 7. The angle of the mortar directing guide 72 should be sharp enough to permit the mortar to flow freely out of the exit ports 74 and 76 at substantially the same rate at the beginning of a run as at the end of a run. It has been found that free flow of mortar out the discharge element 66 can be achieved when the angle of the mortar directing guide 72 is 90° or smaller. Ideal results have been obtained with a mortar directing guide 72 having an angle of 60° or smaller. In one configuration, the mortar directing guide 72 is connected inside the discharge element 66 and the discharge element 66 is affixed to the side walls of the hopper 14 at side extensions 90. In this configuration, different sized walls can be accommodated by the mortar applying device 10 simply by fitting on the hopper 14 an appropriate discharge element 66 with a connected mortar directing guide 72 which has the exit ports 74 and 76 appropriately spaced apart. As discussed above, the side wall guides 46 are moved to appropriate positions on the cross-bar 48 to accommodate the width of the wall under construction. Alternatively, different mortar directing guides 72 could be placed inside the discharge element. FIG. 9 shows an A-frame design 92 which is separable from the discharge element 66. The A-frame design 92 is especially advantageous if a discharge guide 72 configuration as shown in FIG. 6*b* is preferred where the top 94 of the A-frame will extend up the front wall 60 of the hopper 14 and the bottom 96 of the A-frame will be connected at the bottom 64 of the hopper 14. The A-frame design 92 shown in FIG. 9 further emphasizes that ideal mortar deposition on the top of a wall can be achieved when the angle of the mortar discharge element is 60° or less.

While the invention has been described in terms of its preferred embodiments, those skilled in the art will recognize that the invention can be practiced with modification within the spirit and scope of the appended claims.

Having thus described our invention, what we claim as new and desire to secure by Letters Patent is as follows:

1. A mortar applying device, comprising:

a frame having top, bottom, left and right sides, as well as a front and rear end;

a hopper having four sidewalls and an open bottom and an open top connected to said frame;

a discharge element positioned under said open bottom of said hopper towards said rear end of said frame, said directing mortar to exit ports located towards said left and right sides of said frame;

a plurality of wheels connected to said frame, a first group of said wheels being positioned at said right side of said frame, a second group of said wheels being positioned at said left side of said frame, at least one of said wheels being a drive wheel;

a motor connected to said frame;

means for connecting said motor to said drive wheel for propelling said frame along a top surface of a wall under construction;

guide means positioned on said left and right sides of said frame for guiding said frame on said top surface of said wall under construction; and means for automatically stopping forward progress of said frame at an end point of said wall under construction, said means for automatically stopping forward progress including (i) a motor cut-off switch, and (ii) a means for sensing both a wall endpoint which abuts against a higher wall and a wall endpoint with no abutting wall.

2. A mortar applying device, comprising:

a frame having top, bottom, left and right sides, as well as a front and rear end;

a hopper having four sidewalls and an open bottom and an open top connected to said frame;

a discharge element positioned under said open bottom of said hopper towards said rear end of said frame, said discharge element having an angled discharge guide for directing mortar to exit ports located towards said left and right sides of said frame;

a plurality of wheels connected to said frame, a first group of said wheels being positioned at said right side of said frame, a second group of said wheels being positioned at said left side of said frame, at least one of said wheels being a drive wheel;

a motor connected to said frame;

means for connecting said motor to said drive wheel for propelling said frame along a top surface of a wall under construction;

guide means positioned on said left and right sides of said frame for guiding said frame on said top surface of said wall under construction; and means for automatically stopping forward progress of said frame at an end point of said wall under construction, said means for automatically stopping forward progress including (i) a motor cut-off switch, and (ii) a means for sensing both a wall endpoint which abuts against a higher wall and a wall endpoint with no abutting wall, said means for sensing includes an arm extending from said front end of said frame, said arm being connected to said frame by a pivot pin connected to said frame which slides within a slot in said arm, said arm being pivotable about said pivot pin so that a portion of said arm can actuate said motor cut-off switch, and a wheel connected to said arm which rides along said top surface of said wall under construction in front of said frame.

3. A mortar applying device as recited in claim 1 wherein said motor cut-off switch turns off said motor.

4. A mortar applying device as recited in claim 1 wherein said motor cut-off switch halts the forward progress of said frame.

5. A mortar applying device as recited in claim 1 wherein said four side walls of said hopper and said angled discharge guide of said discharge element are lined at an inside surface with a low coefficient of friction, low adhesion material.

6. A mortar applying device as recited in claim 1 wherein said plurality of wheels are provided with a means to adjust to contours on a top surface of a wall under construction.

7. A mortar applying device as recited in claim 6 wherein said means to adjust to contours includes a spring bias connected to an arm on which a wheel is positioned.

8. A mortar applying device as recited in claim 6 wherein said means to adjust to contours includes a pivot element connected between an adjacent pair of wheels which allows a front wheel of said pair of adjacent wheels to pivot relative to a rear wheel of said pair of adjacent wheels depending on the height of a pair of adjacent blocks in a wall under construction.

9. A mortar applying device as recited in claim 1 wherein said plurality of wheels includes at least two pairs of drive wheels wherein a first pair of said drive wheels is located towards said front end of said frame and a second pair of said drive wheels is located towards a rear end of said frame, said first pair and said second pair of said drive wheels being spaced apart by a distance larger than a length of a block in the wall under construction.

10. A mortar applying device as recited in claim 1 wherein said angled discharge guide of said discharge element has an angle of 60° or less.

11. A mortar applying device as recited in claim 1 further comprising a means for controlling a rate of travel of said mortar applying device across the top surface of the wall under construction.

12. A mortar applying device as recited in claim 1 wherein said means for controlling a rate of travel includes a variable speed pulley connected between said motor and said means for connecting said motor to said drive wheel.

13. A mortar applying device as recited in claim 1 wherein said motor is gasoline powered.

14. A mortar applying device as recited in claim 1 further comprising a clutch connected to said means for connecting said motor to said drive wheel, said clutch permitting temporary disengagement of power from said motor to said drive wheel.

15. A mortar applying device as recited in claim 1 further comprising a means for accommodating walls made from blocks having different widths, said means for accommodating including a means for positioning said guide means at varying widths apart and means for altering said discharge element so that said exit ports are varying widths apart.

16. A mortar applying device as recited in claim 1 wherein said discharge element includes a pair of gates located at each of said exit ports, said gates allowing a variable sized opening from said exit ports so that ribbons of mortar which exit said discharge element can have controlled heights, each of said gates having a bevelled bottom edge to smooth over a top surface of said ribbons of mortar.

* * * * *